US007430842B2

(12) United States Patent
De Vos

(10) Patent No.: US 7,430,842 B2
(45) Date of Patent: Oct. 7, 2008

(54) PROTECTED VIAL, AND METHOD FOR MANUFACTURING SAME

(75) Inventor: Dick De Vos, Oegstgeest (NL)

(73) Assignee: Pharmachemie B.V., Haarlem (NL)

( * ) Notice: Subject to any disclaimer, the term of this patent is extended or adjusted under 35 U.S.C. 154(b) by 216 days.

(21) Appl. No.: 11/002,451

(22) Filed: Dec. 2, 2004

(65) Prior Publication Data

US 2006/0037287 A1 Feb. 23, 2006

(30) Foreign Application Priority Data

Aug. 19, 2004 (NL) ..... 1026870
Oct. 5, 2004 (NL) ..... 1027179

(51) Int. Cl.
*B65B 11/58* (2006.01)
*B65B 3/04* (2006.01)
*B65D 23/08* (2006.01)
*B65B 7/28* (2006.01)

(52) U.S. Cl. ..... 53/449; 53/467; 53/284.6; 53/286; 215/12.2

(58) Field of Classification Search ..... 53/477, 53/449, 284.5, 284.6, 286, 389.1, 467, 471; 215/12.1, 12.2
See application file for complete search history.

(56) References Cited

U.S. PATENT DOCUMENTS 3,733,002 A 5/1973 Fujio
3,826,059 A 7/1974 Novitch
3,955,020 A * 5/1976 Cavanagh et al. ..... 428/34.7
4,015,401 A 4/1977 St. Amand et al.
4,138,026 A 2/1979 Conklin et al.
4,544,073 A * 10/1985 Willis ..... 215/246
4,546,881 A * 10/1985 Tasma ..... 426/124
4,678,083 A * 7/1987 Anderson ..... 206/459.1
5,000,804 A * 3/1991 Nugent ..... 156/85
6,050,400 A * 4/2000 Taskis et al. ..... 206/204
6,296,129 B1 10/2001 Kawasaki

FOREIGN PATENT DOCUMENTS

FR 2194640 3/1974

OTHER PUBLICATIONS

Search Report for NL Application No. 1027179.
Mayne, Onco-Train, http://www.us.maynepharma.com/PDF/OncoTain_SalesAid.pdf, two pages.

* cited by examiner

*Primary Examiner*—Paul R Durand
(74) *Attorney, Agent, or Firm*—Troutman Sanders LLP; Ryan A. Schneider; James Hunt Yancey, Jr

(57) ABSTRACT

For the prevention of contamination of a vial with traces of medicinal fluids, for example cytostatics and antibiotics, which may be spilt on the outside of the vial while filling, the vial is provided with a tight-fitting protective envelope, preferably made of a transparent synthetic material, as a last step in the production process. Because of this, a possible contamination which remains on the outside of the vial is encapsulated between the vial and the envelope. Hereby, a user is no longer exposed to toxic substances, because the user will not touch the vial itself, but will touch the envelope. An additional advantage of the provision of the envelope is that if breaking of the vial occurs, the envelope will keep the pieces of broken glass together and will possibly prevent the medicinal fluid from leaking away.

4 Claims, 3 Drawing Sheets

PROTECTED VIAL, AND METHOD FOR MANUFACTURING SAME

FIELD OF THE INVENTION

The invention relates to a method for manufacturing a protected vial and to a protected vial which can be manufactured according to this method.

BACKGROUND OF THE INVENTION

Vials are frequently used in medical practice. Usually, vials consist of a container filled with a medicinal fluid and sealed with a seal which can be pierced with a hypodermic needle. The vial is often also provided with a protective cap which needs to be removed before use. In the process of producing these vials, there is a considerable chance of medicinal fluid ending up on the outside of the vial. Therefore, after filling and sealing, the vials are rinsed in order to remove this fluid. However, it is known from practice that the outside of a vial is not always clean, i.e. free from contamination with an active substance. In that case, rinsing has not led to complete removal, and still traces of the active substance have remained.

Often, the fact that traces of an active substance remain does not constitute a problem, but in certain cases, such as for example in the case of cytostatics and antibiotics, this is different. For instance, it is known that cytostatics can absorb on glass. This may then cause hospital and pharmacy employees, in dealing with such vials, to undesirably get in contact with these possibly highly toxic substances. In the case of antibiotics, contamination on the outside is undesirable, because this may lead to faster resistance of micro-organisms against the antibiotics concerned when these micro-organisms get in contact with the vial, or when the antibiotics concerned get in contact with micro-organisms carried by hospital and pharmacy employees.

SUMMARY OF THE INVENTION

An important objective of the present invention is to cancel the above-mentioned disadvantages and thereby preventing its negative consequences. To that end, the present invention provides a method for manufacturing a protected vial, wherein a tight-fitting envelope is applied around a vial after its filling and sealing.

Because of this, a possible contamination which remains on the outside of the vial after rinsing the vial is encapsulated between the vial and the tight-fitting envelope. Hereby, a user is no longer exposed to toxic substances, because the user will not touch the vial itself, but will touch the envelope. Because the envelope fits tightly around the vial, one keeps the normal physical "feeling" with the vial during use, so that its further processing remains the same. With regard to developing resistance, micro-organisms now do not get a chance to get in contact with traces of antibiotics on the outside of the vial. An additional advantage is that if a vial breaks, the envelope will still take care of holding the pieces of glass together, and possibly the fluid is prevented from leaking away.

The application of a protective envelope takes place after successively filling and sealing the vial; however, it is also possible that the vial is first provided with a sealing member, then filled and subsequently provided with the protective envelope.

In a preferred embodiment of the invention, a glass vial is provided with a tight-fitting synthetic envelope over its entire outside, with the exception of the protective cap. This envelope has been slid over the vial with little space and has shrunk under application of heat, and is thereby fitted tightly around the vial. The envelope may exist as one piece. However, it may also be composed of two parts, wherein the bottom of the vial is covered by a sticker and the side wall is covered by a sleeve, partly overlapping the sticker along a circumferential edge of the bottom.

BRIEF DESCRIPTION OF THE DRAWINGS

These and other aspects, features and advantages of the present invention will be further explained by the following description with reference to the attached drawing, in which.

DETAILED DESCRIPTION OF THE INVENTION

Figure 1:
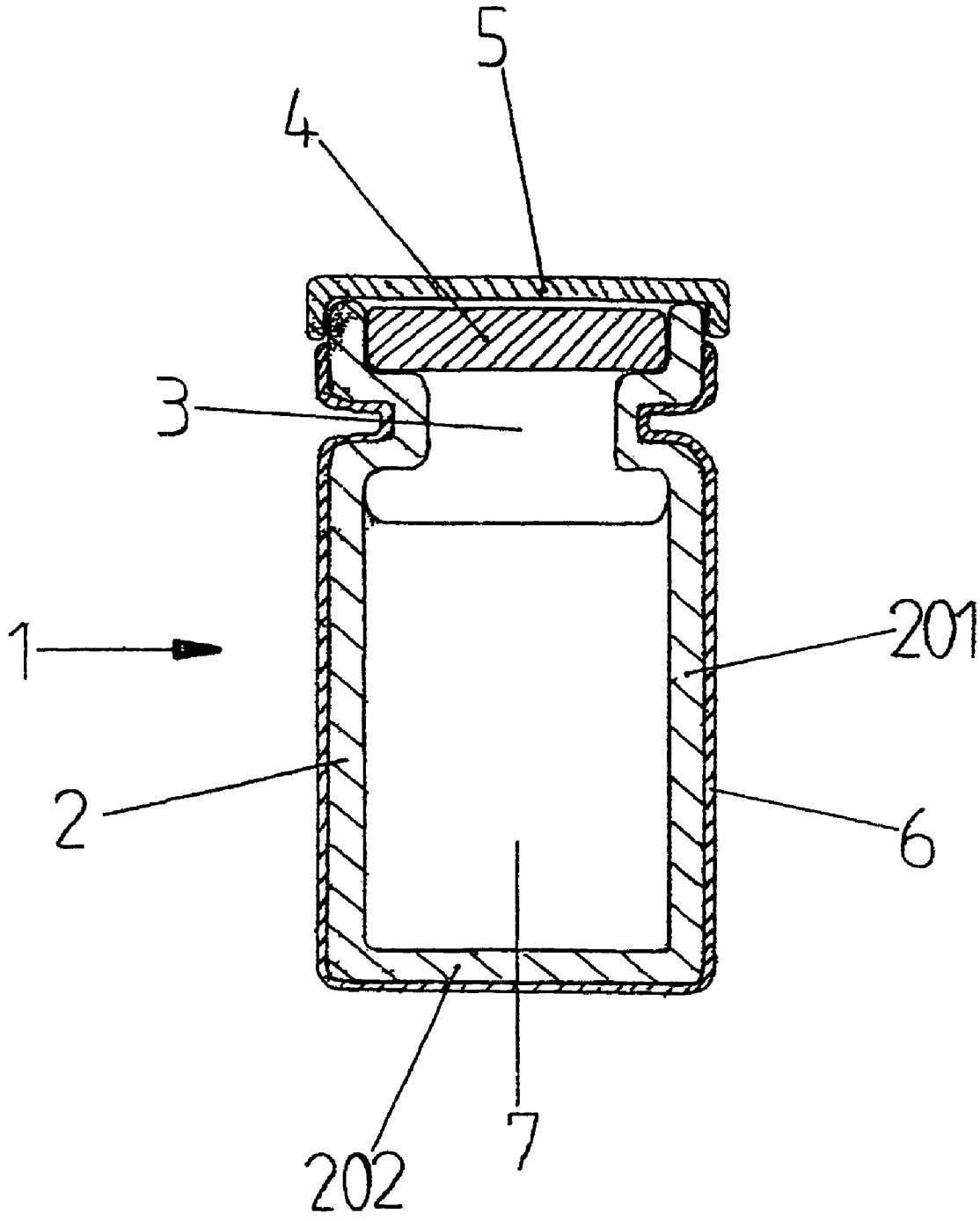
FIG. 1 shows a cross section of a protected vial according to the invention.

In FIG. 1, a cross section is shown of a filled and sealed protected vial 1 according to the present invention. The protected vial 1 consists of a glass vial 2 known per se with a side wall 201, a bottom 202 and an access opening 3. In the vial 2, a medicinal fluid 7 is present. The protected vial 1 is provided with a pierceable sealing member 4, for example of rubber, and a protective cap 5, for example of metal. On the outside of the vial 2, an envelope 6 is fitted tightly over almost the entire vial 2, leaving the protective cap 5 free. Preferably, the envelope 6 is made of a transparent synthetic material, for example a film of PE, PP, PVC or the like. A suitable value for the thickness of the envelope 6 is 0.05 mm; but the value for the thickness may also be higher or lower. For sake of clarity, in FIG. 1, some parts of the protected vial 1 are shown in an exaggeratedly thick fashion.

Figure 1A:
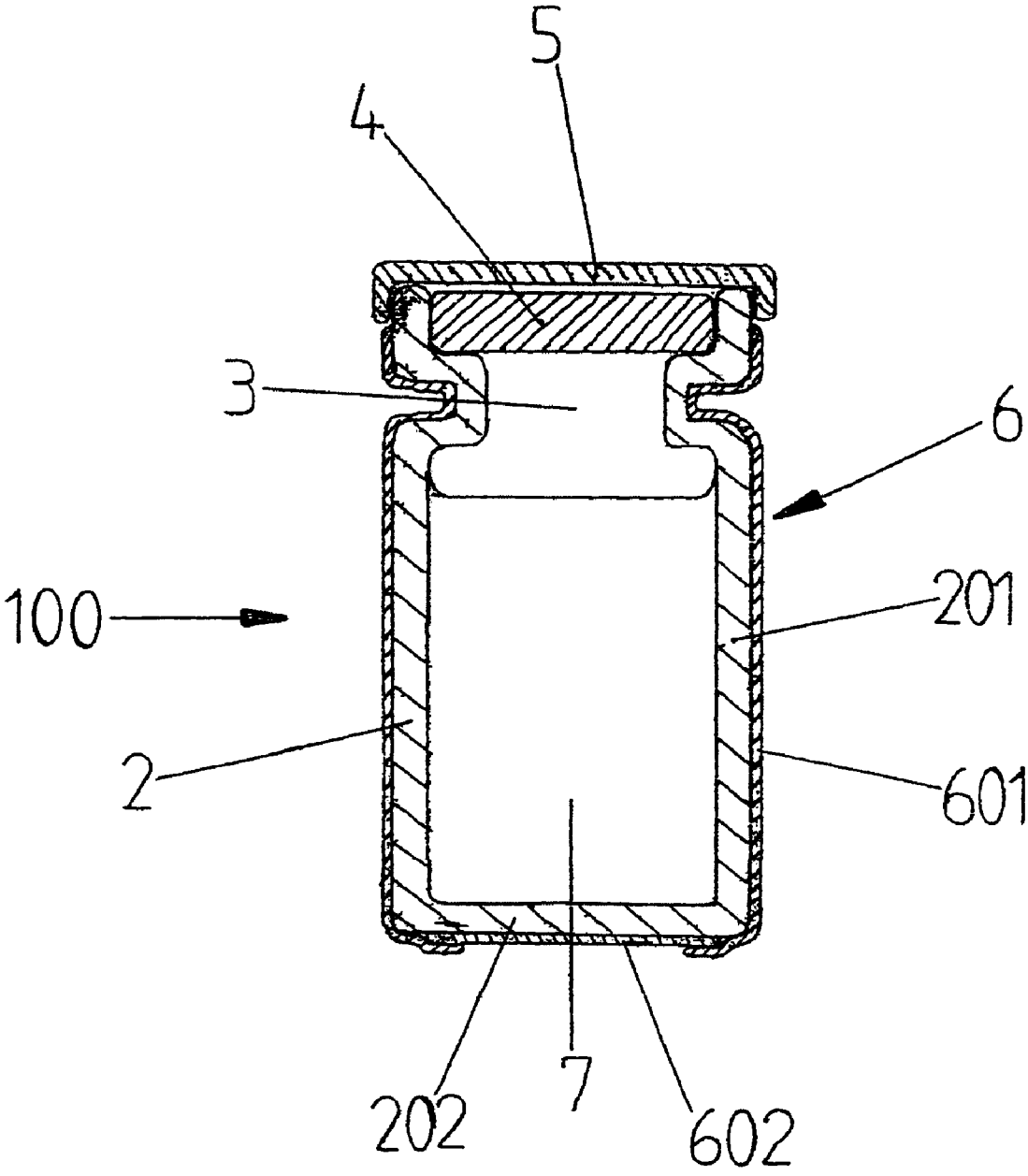
FIG. 1A shows a cross section of a protected vial according to the invention with a bottom sticker, and FIGS. 2A-E schematically illustrate the successive steps of manufacturing of the protected vial of FIG. 1.

In FIG. 1A, a cross section is shown of a slightly different embodiment of the protected vial. In the following, this vial will be referred to as protected vial 100 with a bottom sticker. The above description of the protected vial 1 as shown in FIG. 1 is also applicable to the protected vial 100 with a bottom sticker, with the difference that the envelope 6 comprises two parts, namely a sleeve 601 covering a the side wall 201 of the vial 2, while leaving almost the entire bottom 202 of the vial 2 free, and a separate bottom sticker 602 covering the bottom 202 of the vial 2. The sleeve 601 partly overlaps the bottom sticker 602 along a circumferential edge of the bottom 202. Preferably, the bottom sticker 602 is also made of a transparent synthetic material and has a thickness in the order of approximately 0.15 mm. Furthermore, it is preferable that the bottom sticker 602 is self-adhesive, but this is not necessary within the scope of the invention.

Figure 2:
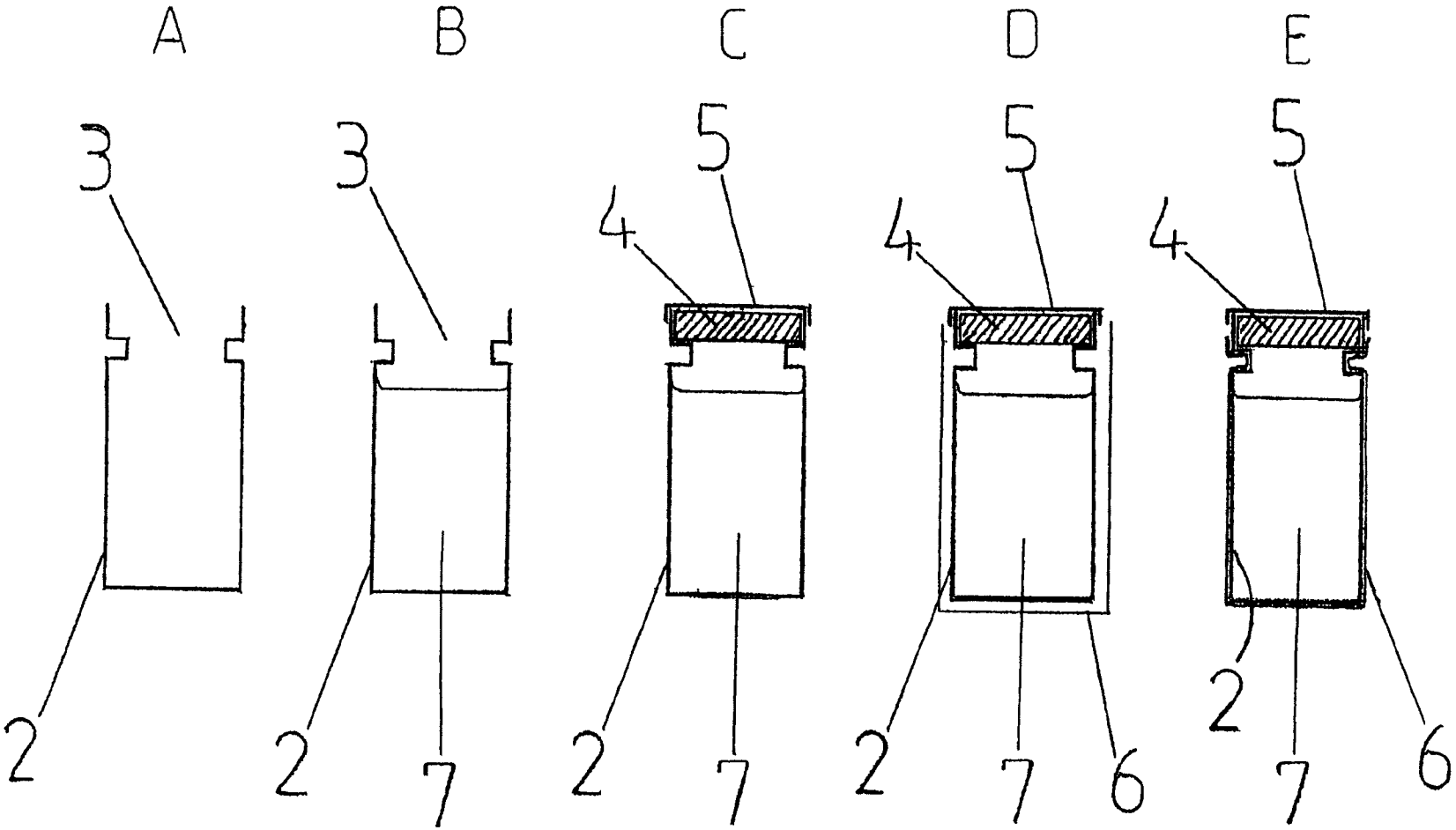

The protected vial 1 is manufactured in steps which are described in the following and which are illustrated in the FIGS. 2A-E, in a simplified way. At first an empty vial 2, known per se, is provided (FIG. 2A). Then, this vial 2 is filled with a medicinal fluid 7, through the access opening 3 (FIG. 2B). Subsequently, a sealing member 4 is attached to the access opening 3 and a protective cap 5 is attached (FIG. 2C). Then, the whole is rinsed in order to remove the fluid which has possibly been spilt on the outside of the vial 2 during filling. Subsequently, a synthetic envelope 6 is slid over the vial 2 (FIG. 2D). As last step, the synthetic envelope 6 is subjected to a heat treatment, in such a way that it shrinks and thereby becomes fitted tightly around the vial 2 (FIG. 2E).

Alternatively, filling the vial 2 may also take place after attaching the sealing member 4.

In a manufacturing process suitable for manufacturing a protected vial 100 with a bottom sticker, a bottom sticker 602 is attached to the bottom 202 of the vial 2 before the synthetic sleeve 601 is slid over the vial 2.

In order to investigate the effect of providing vials 2 with a sleeve 601 and a bottom sticker 602 on an outside contamination of the vials, tests have been performed (Report for Pharmachemie BV, Haarlem, The Netherlands, by Exposure Control BV, Wijchen, The Netherlands and University Medical Center Nijmegen, Nijmegen, The Netherlands), during which the outside contamination of protected vials 100 and unprotected vials 2 containing cisplatin was measured. Extracts from the outside of the vials were destructed into platinum and analyzed with stripping voltametry (Metrohm Application Bulletin No. 220/1. Determine of ultratrace levels of platinum by stripping voltametry). Details of the tests are presented in the following table.

| Batch | Vials without protection | Protected vials |
|---|---|---|
| Number of vials | 7566 | 4067 |
| Cisplatin (mg) | 25 | 50 |
| Volume cisplatin (ml) | 50 | 100 |
| Cisplatin (mg/ml) | 0.5 | 0.5 |
| Surface area ($cm^2$) | 120 | 180 |
| Extraction volume (ml HCl) | 70 | 300 |

The tested vials were put in a single container. The containers were filled with 0.5 M HCl until the vials were completely immersed. The containers were closed, and after ultrasonification for 30 minutes, the vials were removed from the containers. During ultrasonification, cisplatin contamination on the outside of the vials was assumed to be dissolved in the HCl solvent.

Sample pre-treatment and analysis with stripping voltametry was performed according to standard procedures. One ml of the cisplatin extract was destructed into a platinum-complex using hydrogen peroxide, formaldehyde and UV-light, resulting in the formation of platinum (Pt). It is a known fact that cisplatin contains about 65% platinum. Analysis of platinum was performed in triplicate with a relative standard deviation of 2-3%. The limit of detection was 10 ng/l of extract. Samples were diluted and reanalyzed in case high concentrations were encountered. Ten blank samples (empty vials) were extracted, analyzed and compared to the cisplatin vials to correct for background values of platinum (50 ng/l extract).

Values of absolute amounts of contamination found on the vials (Pt-abs) were compared between the protected vials 100 and the unprotected vials 2 with a Wilcoxon test. This test was also applied on the values of contamination per area surface (Pt-area), the values of contamination related to the contents of the vial (Pt-ratio out/in) and to all values corrected for blanks. P-values of 0.05 or less were considered significant. Data were characterized by median, range and quartiles.

Results of the tests are presented in the following table.

| | Unprotected vials | | | Protected vials | | |
|---|---|---|---|---|---|---|
| Batch | Pt-abs (ng) | PT-area ($ng/cm^2$) | Pt-ratio out/in ($\times 10^{-6}$) | Pt-abs (ng) | PT-area ($ng/cm^2$) | Pt-ratio out/in ($\times 10^{-6}$) |
| Min | 3 | 0.02 | 0.17 | BV* | BV* | BV* |
| Max | 79 | 0.66 | 4.85 | 146 | 0.81 | 4.49 |
| Median | 7 | 0.06 | 0.43 | 4 | 0.02 | 0.11 |

*BV = Background Values

It is clear from the above table, in particular from the median data, that all parameters are significantly lower for the protected vials 100 compared to the unprotected vials 2. This proves that providing the vial 2 with an envelope 6 leads to a significant reduction of the outside contamination of the vial 2.

In order to investigate the effect of providing vials 2 with a sleeve 601 and a bottom sticker 602 on risks associated with accidental dropping of the thus obtained protected vials 100, drop tests have been performed (Report for Pharmachemie BV, Haarlem, The Netherlands, by Topa Instituut, Voorhout, the Netherlands; report number T04-1068). The applied test procedure consists of the following parts:

1) Drop Test from Drop Height of 120 cm

This test has been performed to simulate the accidental dropping of protected vials 100 from a table on a hospital floor. The drop height is 120 cm on random positions of the vials 100 (top, bottom or side). The surface on which the drops have taken place is a "Linoleum" plate, which simulates a hospital floor. Five drops have been performed with three different types of vials, namely 10 ml vials, 50 ml vials and 100 ml vials.

2) Drop Test from Drop Height of 185 cm

This test has been performed to see what happens if the protected vial 100 falls from a shelf on a hospital floor. The drop height is 185 cm on random positions of the vials 100 (top, bottom or side). The surface on which the drops take place is the above-mentioned "Linoleum" plate.

The results of the drop test from the drop height of 120 cm are presented in the following table. For sake of completeness, it is noted that, in the table, the protected vials 100 are indicated as vials with cover, whereas unprotected vials 2, i.e. vials 2 without an envelope 6, are indicated as vials without cover.

| | | Drop height 120 cm | | | | | |
|---|---|---|---|---|---|---|---|
| | | 10 ml vials With cover Results | Without cover Results | 50 ml vials With cover Results | Without cover Results | 100 ml vials With cover Results | Without cover Results |
| Drop on bottom | 1 | ok | ok | ok | ok | ok | ok |
| | 2 | ok | ok | ok | ok | ok | ok |
| Drop on top | 1 | ok | ok | ok | ok | ok | ok |
| | 2 | ok | ok | ok | ok | ok | ok |
| Drop on side | 1 | ok | ok | ok | ok | ok | ok |
| Total % intact | | 100% | 100% | 100% | 100% | 100% | 100% |

The results of the drop test from the drop height of 185 cm are presented in the following table.

| | | Drop height 185 cm | | | | | |
|---|---|---|---|---|---|---|---|
| | | 10 ml vials With cover Results | Without cover Results | 50 ml vials With cover Results | Without cover Results | 100 ml vials With cover Results | Without cover Results |
| Drop on bottom | 1 | ok | ok | ok | ok | ok | ok |
| | 2 | ok | ok | ok | ok | ok | ok |
| | 3 | broken | ok | ok | ok | ok | ok |
| | 4 | ok | ok | ok | ok | broken | ok |
| | 5 | ok | ok | ok | ok | ok | ok |
| | 6 | ok | ok | ok | ok | — | — |
| | 7 | ok | ok | ok | ok | — | — |
| | 8 | ok | broken | ok | ok | — | — |
| | 9 | ok | ok | ok | ok | — | — |
| | 10 | ok | ok | ok | ok | — | — |
| Drop on top | 1 | ok | ok | ok | ok | ok | ok |
| | 2 | ok | ok | ok | ok | ok | ok |
| | 3 | ok | ok | ok | ok | ok | ok |
| | 4 | ok | ok | ok | ok | ok | ok |
| | 5 | ok | ok | ok | ok | ok | ok |
| | 6 | ok | ok | ok | ok | — | — |
| | 7 | ok | ok | ok | ok | — | — |
| | 8 | ok | ok | ok | ok | — | — |
| | 9 | ok | ok | ok | ok | — | — |
| | 10 | ok | ok | ok | ok | — | — |
| Drop on side | 1 | ok | ok | broken | broken | broken | broken |
| | 2 | ok | ok | cracked | ok | broken | broken |
| | 3 | ok | ok | ok | broken | broken | broken |
| | 4 | ok | ok | ok | ok | broken | broken |
| | 5 | ok | ok | ok | ok | broken | broken |
| | 6 | ok | ok | ok | broken | cracked | ok |
| | 7 | ok | ok | cracked | ok | cracked | broken |
| | 8 | ok | ok | cracked | ok | ok | broken |
| | 9 | ok | ok | ok | ok | cracked | broken |
| | 10 | ok | ok | ok | ok | broken | broken |
| Total % intact | | 96.7% | 96.7% | 86.7% | 90.0% | 50.0% | 50.0% |

From the results of the drop tests, it is concluded that providing a vial 2 with a sleeve 601 and a bottom sticker 602 does not lead to an improved protection of the vials 2 against breakage, However, it has appeared that if such a vial 2 sustains damage, the vial 2 often gets cracked rather than broken. Furthermore, it has appeared that if such a vial 2 breaks or cracks, in 50% of these cases, the vial 2 still contains its contents. In all cases of breakage of an unprotected vial 2, the contents are spilled over the floor. Therefore, the conclusion is justified that the application of the sleeve 601 and the bottom sticker 602 leads to a safer handling of the vials.

The above-described embodiments are merely illustrations of possibilities of the present invention. Several modifications and adjustments are possible within the scope of protection of the invention as defined by the attached claims.

What is claimed is:

1. A method for manufacturing a protected vial, the method comprising:

providing a vial with a side wall, a bottom defining a bottom surface, and an access opening;

filling the vial with a medicinal fluid;

attaching a sealing member to the access opening;

attaching a protective cap to the sealing member;

arranging a tight-fitting envelope around the vial such that the envelope conforms to the shape of the vial;

wherein arranging the envelope takes place after filling the vial and attaching the sealing member; and wherein arranging the envelope comprises arranging a bottom sticker against the bottom surface of the vial, and subsequently arranging a tight-fitting sleeve over the entire side wall of the vial, leaving the protective cap free and partly overlapping the bottom sticker along a circumferential edge of the bottom surface.

2. A method according to claim 1, wherein the sleeve is slid over the vial with little space, and wherein subsequently a heat treatment is performed, in such a way that the sleeve shrinks, thereby fitting itself tightly around the vial.

3. Protected vial, comprising a filled and sealed vial with a side wall, a bottom defining a bottom surface having a circumferential edge proximate a bottom portion of the side wall, and an access opening disposed distal from the bottom surface, a sealing member which is attached to the access opening, and a protective cap which is attached to the sealing member, wherein a tight-fitting envelope is arranged around the filled and sealed vial such that the envelope conforms to the shape of the vial, and wherein the envelope comprises a bottom sticker which is arranged against the bottom surface of the vial, and a tight-fitting sleeve which is arranged over the entire side wall of the vial, leaving the protective cap free and partly overlapping the bottom sticker along the circumferential edge of the bottom surface proximate a bottom portion of the side wall.

4. Protected vial according to claim 3, wherein the protected vial is manufactured by the method according to claim 1.

* * * * *